United States Patent [19]

Hirano et al.

[11] Patent Number: 4,947,724

[45] Date of Patent: Aug. 14, 1990

[54] ELECTRIC MUSIC INSTRUMENT WITH THE CAPABILITY OF MEMORIZING AND PRODUCING DIFFERENT MUSICAL SCALES

[75] Inventors: Katsuhiko Hirano; Masahiko Koike; Hiroyuki Toda, all of Hamamatsu, Japan

[73] Assignee: Yamaha Corporation, Hamamatsu, Japan

[21] Appl. No.: 418,907

[22] Filed: Oct. 5, 1989

Related U.S. Application Data

[63] Continuation of Ser. No. 125,394, Nov. 25, 1987, abandoned.

[30] Foreign Application Priority Data

Nov. 28, 1986 [JP] Japan ..... 61-283356
Jan. 17, 1987 [JP] Japan ..... 62-8676

[51] Int. Cl.[5] ..... G10C 3/12; G10H 1/053; G10H 7/00

[52] U.S. Cl. ..... 84/631; 84/708; 84/451; 84/DIG. 4

[58] Field of Search ..... 84/622–625, 84/631, 659–661, 664, 692–700, 708, 451, 454, 477 R, 478, DIG. 4

[56] References Cited

U.S. PATENT DOCUMENTS 3,882,751 5/1975 Tomisawa et al. ..... 84/1.01
4,014,242 3/1977 Sanderson ..... 84/454
4,082,027 4/1978 Hiyoshi et al. ..... 84/1.19 X
4,145,943 3/1979 Luce ..... 84/DIG. 4 X
4,228,717 10/1980 Luce ..... 84/DIG. 4 X
4,484,506 11/1984 Sato ..... 84/454 X
4,538,495 9/1985 Sato ..... 84/1.19

OTHER PUBLICATIONS

Japanese Patent Laid-Open Specification No. Sho 60-178493.

*Primary Examiner*—Stanley J. Witkowski
*Attorney, Agent, or Firm*—Blakely, Sokoloff, Taylor & Zafman

[57] ABSTRACT

An electronic musical instrument with plural pitch data generating functions includes a keyboard, a plurality of tone generating units, a pitch designating unit, a plural pitch data generating unit, and a musical tone generating unit. The keyboard has a plurality of keys. The tone generating units generate at least two tone signals in response to operation of a key among the plural keys. The pitch designating unit designates a pitch of a musical tone to be produced. The plural pitch data generating unit generates at least two pitch data based on the pitch and in accordance with different scale characteristics. The musical tone generating unit generates at least two musical tone signals based on at least two pitch data respectively, so that at least two musical tone signals have the different scale characteristics.

7 Claims, 9 Drawing Sheets

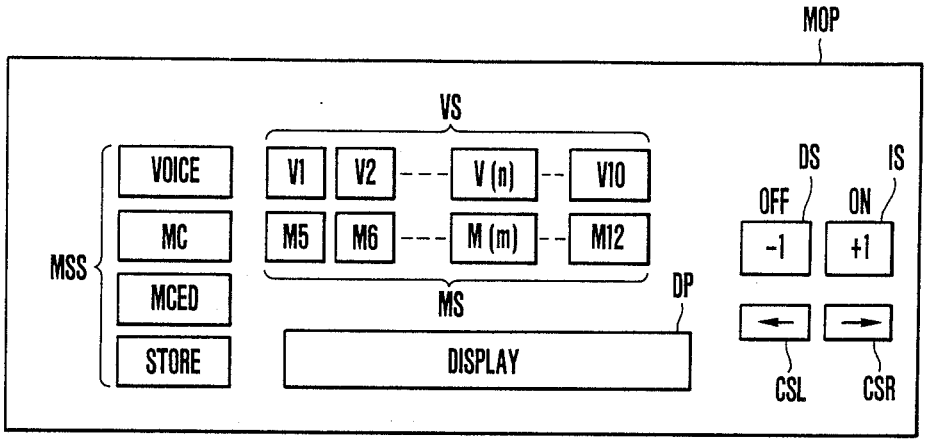
FIG.2
FIG.3(A)
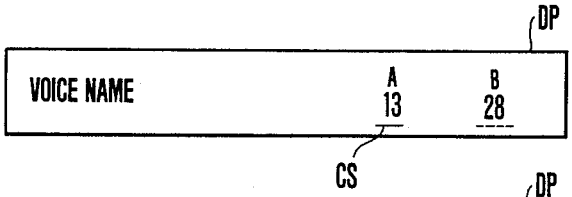
FIG.3(B)
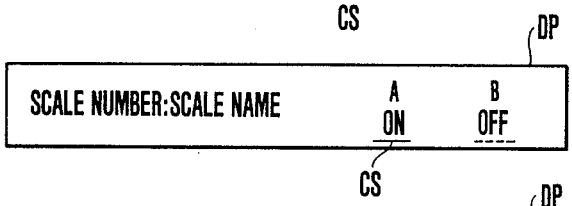
FIG.3(C)
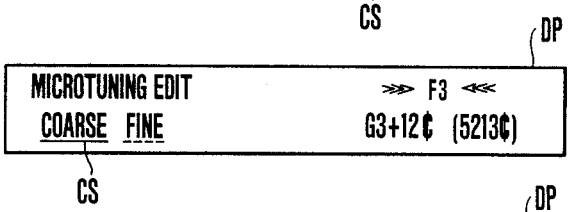
FIG.3(D)
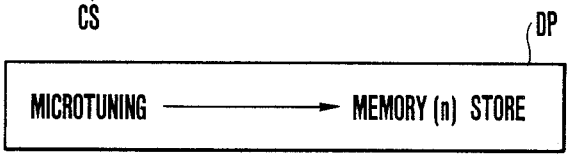
FIG.3(E)
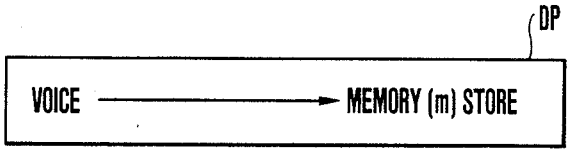

ELECTRIC MUSIC INSTRUMENT WITH THE CAPABILITY OF MEMORIZING AND PRODUCING DIFFERENT MUSICAL SCALES

This is a continuation of application Serial No. 125,394 filed Nov. 25, 1987 and now abandoned. Background of the Invention The present invention relates to an electronic musical instrument.

Some conventional electronic musical instruments generate a musical tone from any sound source in accordance with a temperament scale.

Generally, when an ensemble is performed using a plurality of types of acoustic musical instruments, pitch curves of all the musical instruments are rarely the same. For example, the pitch curves are based on different scales such as a temperament scale and an enharmonic scale. For this reason, a frequency is shifted for each key, so that a comfortable beating effect can be obtained.

On the contrary, according to the conventional electronic musical instruments described above, even if a plurality of sound sources are set to have different tone colors and caused to generate tones at the same time, a performance effect such as an ensemble performance produced by acoustic musical instruments cannot be obtained.

A conventional keyboard-type electronic musical instrument in which a pitch can be adjusted in units of letter names is known (e.g., Japanese Patent Laid-Open (Kokai) No. 60-178493). In this electronic musical instrument, an up/down operating element corresponding to a given letter name is operated to increase/decrease a pitch of the letter name in units of 0.1 cent.

However, according to the above conventional electronic musical instrument, a pitch is adjusted in units of letter names. Therefore, if a key range of a keyboard covers a plurality of octaves, changes in pitches of keys having the same letter name but in different octaves become the same. As a result, a demand for enjoying expressive performance by assigning a given pitch to each key cannot be satisfied.

In addition, since pitch change is a small value of 0.1 cent or the like, it takes a long time and a great effort to obtain pitch increase (or decrease) of, e.g., halftone (100 cents). In order to reduce such time and effort, a pitch may be changed in units of large values, e.g., 10 cents. In this case, however, a pitch cannot be precisely set.

SUMMARY OF THE INVENTION

It is, therefore, a principal object of the present invention to provide an electronic musical instrument by which a performer can enjoy more expressive performance than by a conventional electronic musical instrument.

It is another object of the present invention to provide an electronic musical instrument by which a performance effect similar to an ensemble performance produced by acoustic instruments can be obtained.

It is still another object of the present invention to provide an electronic musical instrument in which a pitch can be precisely set.

It is still another object of the present invention to provide an electronic musical instrument which realizes the above objects and in which an adjusting mode can be changed.

It is still another object of the present invention to provide an electronic musical instrument which realizes the above objects and in which the number of operating elements for adjustment can be reduced to simplify a panel arrangement and a circuit arrangement.

In order to achieve the above objects of the present invention, there is provided an electronic musical instrument with plural pitch data generating function comprising: a keyboard means having a plurality of keys; a plurality of tone generating means for generating at least two tone signals in response to operation of a key among the plural keys; a pitch designating means for designating a pitch of a musical tone to be produced; a plural pitch data generating means for generating at least two pitch data based on the pitch and in accordance with different scale characteristics; and a musical tone generating means for generating at least two musical tone signals based on at least two pitch data respectively, so that at least two musical tone signals have the different scale characteristics.

BRIEF DESCRIPTION OF THE DRAWINGS

FIG. 2 is a view of an arrangement of operating elements and a display of a microtuning operation section MOP;

FIGS. 3(A) to 3(E) are views of display examples of a display DP in respective modes;

DETAILED DESCRIPTION OF THE PREFERRED EMBODIMENT

Figure 1:
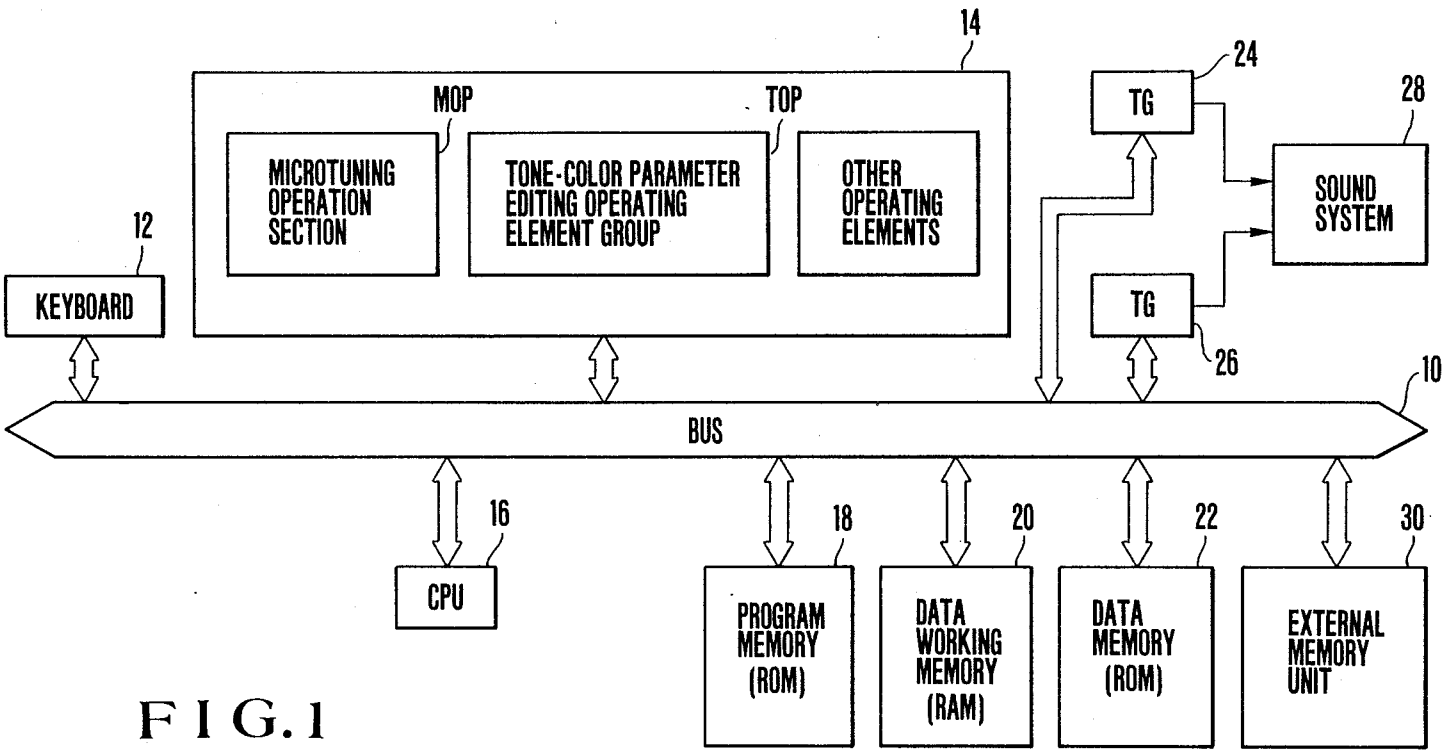
FIG. 1 is a block diagram of a circuit arrangement of an electronic musical instrument according to an embodiment of the present invention.

FIG. 1 shows a circuit arrangement of an electronic musical instrument according to an embodiment of the present invention. In this electronic musical instrument, setting of a pitch curve or a tone color, generation of a musical tone, and the like are controlled by a microcomputer.

Circuit Arrangement (FIG. 1)

A bus 10 is connected to a keyboard 12, a panel operation section 14, a central processing unit (CPU) 16, a program memory 18, a data working memory 20, a data memory 22, tone generators (TG) 24 and 26, an external memory unit 30, and the like.

The keyboard 12 has, e.g., 61 keys, and key operation information is detected for every key.

The panel operation section 14 includes a microtuning operation section MOP, a tone-color parameter editing operating element group TOP, and other operating elements, and operation information is detected for every operating element. The microtuning operation section MOP is used to set a pitch curve or a tone color and will be described later in more detail with reference to FIG. 2.

The CPU 16 executes a variety of operations for setting a pitch curve or a tone color, generating a musical tone, and the like in accordance with programs stored in the program memory 18 consisting of a ROM (Read-Only Memory). These operations will be described later with reference to FIGS. 6 to 13.

The data working memory 20 consists of a RAM (Random Access Memory) and includes a large number of memory blocks used as registers, flags, and the like when the respective operations are executed by the CPU 16. The registers and the like for carrying out the present invention will be described later with reference to FIG. 4.

The data memory 22 consists of a ROM and stores frequency control data of all the keys of each scale such as a temperament scale or an enharmonic scale and tone-color parameter data of 64 tone colors. An arrangement of the memory blocks in the memory 22 will be described later with reference to FIG. 5.

Each of TGs 24 and 26 has a plurality of tone-generating channels (sound sources). A musical tone signal generated from each tone-generating channel is supplied to a sound system 28 and converted into an acoustic sound thereby. A plurality of tone-generating channels in each tone generator may be arranged either time-divisionally or space-divisionally. For example, when 8 tone-generating channels are provided in each tone generator and two tones are generated at the same time for each key, a maximum of musical tones of 8 keys (i.e., 16 tones) can be simultaneously generated.

The external memory unit 30 is constituted by a RAM, a floppy disk, or the like and is used to initialize or store a variety of musical-tone control data.

Microtuning Operation Section MOP (FIG. 2)

FIG. 2 shows an arrangement of the operating element and the display of the microtuning operation section MOP. The operation section MOP includes a mode selection switch group MSS, a voice selection switch group VS, a memory selection switch group MS, a display DP, an increment switch IS, a decrement switch DS, cursor move switches CSR and CSL, and the like.

The mode selection switch group MSS includes a voice mode selection switch VOICE, a microtuning mode selection switch MC, a microtuning edit mode selection switch MCED, and a store mode selection switch STORE.

The voice selection switch group VS includes 10 voice selection switches V1 to V10 respectively corresponding to voice numbers 1 to 10. When the switch VOICE is turned on to select a voice mode, a given voice number can be selected by turning on one of the switches V1 to V10. When a desired voice number is selected, a set of voice reference data is read out from a voice register corresponding to the selected voice number in the memory 20. Therefore, a musical tone can be generated on the basis of the readout data, or the readout data can be partially corrected.

When the switch STORE is turned on to select a store mode, a given voice number can be selected by turning on one of the switches V1 to V10. When a desired voice number is selected, a set of voice reference data is written in a voice register corresponding to the selected voice number in the memory 20. In this case, the written set of voice reference data is the one which is read out from the memory and then used to generate a musical tone or which is partially corrected as described above.

A set of voice reference data stored in each voice register consists of tone-color number data for the TG 24, microtuning on/off data for the TG 24, tone-color number data for the TG 26, microtuning on/off data for the TG 26, and scale number data.

The tone-color number data represents a tone-color number corresponding to a tone color of a specific musical instrument such as a flute, a violin, or the like. In this embodiment, the tone-color number is one of 1 to 64.

The scale number data represents a scale number corresponding to a specific scale. In this embodiment, the scale number is one of 1 to 12. Scale numbers 1 to 4 correspond to four types of scales whose frequency control data are preset by the manufacturer, respectively. For example, the scale number 1 represents an enharmonic scale; 2, a temperament scale; 3, a Pythagorean scale; and 4, a meantone scale. The scale numbers 5 to 12 correspond to 8 types of scales which can be arbitrarily set by a user, respectively.

The microtuning on/off data represents "microtuning on" if it is 1 and "microtuning off" if it is 0. In this case, "microtuning on" means that a scale designated by the scale number data is used in an associated tone generator. In addition, "microtuning off" means that the temperament scale is used in an associated tone generator.

The memory selection switch group MS includes 8 memory selection switches M5 to M12 respectively corresponding to the scale numbers 5 to 12. When the switch STORE is turned on to select the store mode, a given scale number can be selected by turning on one of the switches M5 to M12. When a desired scale number is selected, frequency control data of all the keys are written in a scale register corresponding to the selected scale number in the memory 20. In this case, the written frequency control data of all the keys are used to actually generate a musical tone or corrected as needed.

The display DP consists of, e.g., a liquid crystal display and displays a set amount and the like in relation to mode selection. Display contents related to mode selection will be described later with reference to FIG. 3.

The increment switch IS is used to increase a displayed value or to instruct "microtuning on". The decrement switch DS is used to decrease a displayed value or to instruct "microtuning off".

The cursor move switches CSR and CSL are used to move a cursor on a display screen. The switch CSR is used to move the cursor to the right; and the switch CSL, to the left.

Display Examples (FIGS. 3(A) to 3(E))

FIGS. 3(A) to 3(E) show display examples of the display DP in the respective modes.

FIG. 3(A) shows an example displayed when the switch VOICE is turned on to select the voice mode and then a given voice selection switch V(n) is turned on. In this case, the display DP displays a voice number n or a voice number corresponding thereto and letters "A" and "B" to the right thereof. A tone-color number for determining a tone color of the TG 24 is displayed below letter "A", and a tone-color number for determining a tone color of the TG 26 is displayed below letter "B". At this time, the tone-color numbers are designated by the tone-color number data, for the respective tone generators, included in a group of voice reference data read out from the voice registers during voice selection as described above.

The tone-color number displayed below either letter "A" or "B" can be arbitrarily changed by moving the cursor CS to the letter and turning on the switch IS or DS. In this embodiment, one of the tone-color numbers 1 to 64 can be selected.

FIG. 3(B) shows an example displayed when the switch MC is turned on to select the microtuning mode. Normally, after the desired voice is selected as shown in FIG. 3(A), the microtuning mode is selected. In this case, the display DP displays a scale number and a scale name corresponding to the scale number. At this time, the scale number is designated by the scale number data included in a group of the voice reference data read out from the voice registers during voice selection as described above.

To the right of the scale name, letters "A" and "B" are displayed. Characters "ON" or "OFF" representing on or off of microtuning with respect to the TG 24 are displayed below letter "A", and characters "ON" or "OFF" with respect to the TG 26 are similarly displayed below letter "B". At this time, the on or off state of microtuning is designated by the microtuning on/off data for the respective tone generators included in the group of voice reference data read out from the voice registers during voice selection as described above.

The displayed scale number and scale name can be arbitrarily changed by moving the cursor CS to these positions and turning on the switch IS or DS.

Furthermore, the characters "ON" or "OFF" displayed below either of letter "A" or "B" can be arbitrarily changed by moving the cursor to the letter and turning on the switch IS or DS. That is, in this embodiment, the following four types of microtuning on/off can be set.

(1) Microtuning On for Both TGs 24 and 26 ("A"='-'ON" and "B"="ON")

In this case, a musical tone can be generated in accordance with a scale (e.g., an enharmonic scale) corresponding to a selected scale number for each of the TGs 24 and 26.

(2) Microtuning On for TG 24 and Microtuning Off for TG 26 ("A"="ON" and "Bl"="OFF")

In this case, a musical tone can be generated in accordance with a scale corresponding to a selected scale number for the TG 24, and a musical tone can be generated in accordance with a temperament scale for the TG 26.

(3) Microtuning Off for TG 24 and Microtuning On for TG 26 ("A"="OFF" and "B"="ON")

In this case, contrary to (2), a musical tone can be generated in accordance with the temperament scale for the TG 24, and a musical tone can be generated in accordance with a selected scale number for the TG 26.

(4) Microtuning Off for Both TGs 24 and 26 ("A" ="OFF" and "B"="OFF")

In this case, a musical tone can be generated in accordance with the temperament scale for each of the TGs 24 and 26.

Therefore, by arbitrarily selecting the above set modes (1) to (4), expressive performance can be realized.

FIG. 3(C) shows an example displayed when the switch MCED is turned on to select the microtuning edit mode and then a pitch correction operation is performed. The pitch correction operation is performed, after the desired scale number is displayed as shown in FIG. 3(B), to a scale corresponding to the scale number. When only the switch MCED is turned on before the pitch correction operation starts, the display DP displays characters "MICROTUNING EDIT", "COARSE", and "FINE" and numeral 0. When a key whose pitch is to be changed is turned on, a pitch of the key is displayed as, for example, "F3".

Thereafter, by moving the cursor CS to the characters "COARSE" and turning on the switch IS or DS, a pitch of key can be changed every halftone (i.e., one by one in a key code value). In this case, the display DP displays the pitch after it is changed as, for example, "G3".

In addition, by moving the cursor CS to the characters "FINE" and turning on the switch IS or DS, a pitch of the key can be changed every cent. In this case, the display DP displays a cent value together with a symbol = or −.

When a pitch can be coarsely or finely changed by the "COARSE' or 'FINE' mode as described above, pitch setting can be performed accurately and rapidly.

Regardless of the fact as to whether a pitch is changed by the 'COARSE' or 'FINE' mode, the display DP displays an absolute value of the cent based on the lowest tone of the keyboard in parentheses to the right of a cent value display portion.

FIG. 3(D) shows an example displayed when the switch STORE is turned on to select the store mode and then a given memory selection switch M(m) is turned on. In this case, the display DP displays characters 'MICROTUNING', an arrow in the right direction, and characters 'MEMORY(m) STORE' from the left to the right thereof. This display represents that the frequency control data of all the keys (e.g., data already subjected to pitch correction as shown in FIG. 3(C)) are written in a scale register corresponding to a scale number m in the memory 20.

FIG. 3(E) shows an example displayed when the switch STORE is turned on to select the store mode and then a given voice selection switch V(n) is turned on. In this case, the display DP displays characters "VOICE", an arrow in the right direction, and characters "MEMORY(n) STORE" from the left to the right thereof. This display represents that the group of voice reference data (e.g., data whose contents are already corrected as shown in FIGS. 3(A) and 3(B)) is written in a voice register corresponding to a scale number n in the memory 20.

Figure 4:
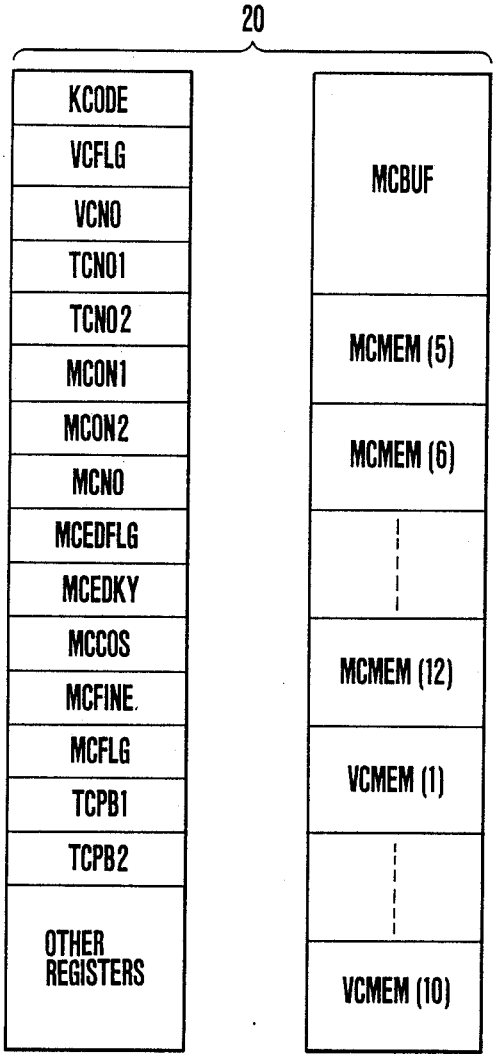
FIG. 4 is a view of an arrangement of registers in a data working memory 20.

Arrangement of Registers in Memory 20 (FIG. 4)

FIG. 4 shows registers for carrying out the present invention of the registers in the data working memory 20. Memory contents of the respective registers are as follows. (1) Key Code Register KCODE A key code corresponding to a key subjected to a key event (key on or key off) is set in this register. (2) Voice Mode Flag VCFLG

1 is set in this flag when the switch VOICE is turned on. (3) Voice Number Register VCNO A voice number selected by one of the switches V1 to V10 during the voice mode is set in this register. (4) First and Second Tone-Color Number Registers TCNO1 and TCN02

Tone-color number data for the TG 24 is stored in the register TCNO1, and tone-color number data for the TG is stored in the register TG 26. (5) First and Second Microtuning On/Off Registers MCON1 and MCON2

Microtuning on/off data for the TG 24 is stored in the register MCON1, and microtuning on/off data for the TG 26 is stored in the register MCON2. (6) Scale Number Register MCNO A scale number is set in this register during the voice mode or the microtuning mode. (7) Microtuning Edit Mode Flag MCEDFLG turned on.

1 is set in this flag when the switch MCED is (8) Microtuning Key Register MCEDKY A key code corresponding to a key which is turned on is set in this flag during the microtuning edit mode. (9) First Edit Register MCCOS A key code corresponding to a key which is depressed during the microtuning edit mode is set in this register. When the "COARSE" mode is selected, the set key code can be changed step by step by turning on the switch IS or DS (10) Second Edit Register MCFINE When the "FINE" mode is selected during the microtuning edit mode, a pitch change amount is set in this register by turning on the switch IS or DS. (11) Microtuning Mode Flag MCFLG 1 is set in this flag when the switch MC is turned on.

(12) First and Second Tone-Color Parameter Buffer Registers TCPB1 and TCPB2

Tone-color parameter data to be supplied to the TG 24 is stored in the register TCPB1, and tone-color parameter data to be supplied to the TG 26 is stored in the register TCPB2. (13) Scale Buffer Register MCBUF Frequency control data of all the keys for a scale corresponding to a scale number set in the register MCNO is stored in this register. (14) Scale Registers MCMEM(1) to MCMEM(12)

These registers correspond to 8 types of scales which a user can set, and each register can store the frequency control data of all the keys. The frequency control data read out from the external memory unit 30 when a power switch is turned on may be initialized in these registers.

(15) Voice Registers VCMEM(1) to VCMEM(10)

These registers correspond to the voice numbers 1 to 10 (switches V1 to V10), respectively, and each register can store the group of voice reference data as described above. The voice reference data read out from the external memory unit 30 when the power switch is turned on may be initialized in these registers.

Although a tone-generation assigning register, a tone-color parameter editing register, and the like are present in addition to the above-mentioned registers, they are not shown.

Figure 5:
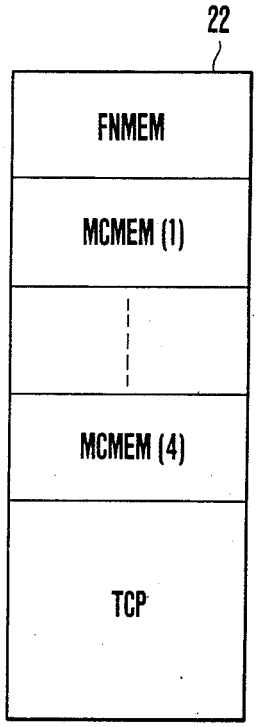
FIG. 5 is a view of an arrangement of memory blocks in a data memory 22.

Arrangement of Memory Blocks in Memory 22 (FIG. 5)

FIG. 5 shows memory blocks for carrying out the present invention of a large number of memory blocks in the data memory 22. Memory contents of the respective blocks are as follows. (1) Temperament Memory Block FNMEN This block stores frequency data of all the keys in accordance with a temperament scale. Data of this memory block is used to cause a tone generator set in microtuning-off to generate a musical tone. Note that this block may store the frequency control data not of all the keys but of 12 letter names so that frequency control data of a letter name corresponding to each key is read out and converted into data corresponding to a key pitch.

(2) Scale Memory Blocks MCMEM(1) to MCMEM(4)

The block MCMEM(1) corresponds to an enharmonic scale, the block MCMEM(2) corresponds to a temperament scale, the block MCMEM(3) corresponds to a Pythagorean scale, and the block MCMEM(4) corresponds to a meantone scale. Each memory block stores frequency control data of all the keys in accordance with a corresponding one of the scales. The above-mentioned register MCBUF stores the frequency control data of all the keys read out from one of the memory blocks MCMEM(1) to MCMEM(4) and the registers MCMEM(5) to MCMEM(12) corresponding to a scale number of the register MCNO.

(3) Tone-Color Parameter Memory Block TCP

This block stores tone-color parameter data of 64 tone colors. Tone-color parameter data corresponding to a tone-color number is read out from this memory block.

Figure 6:
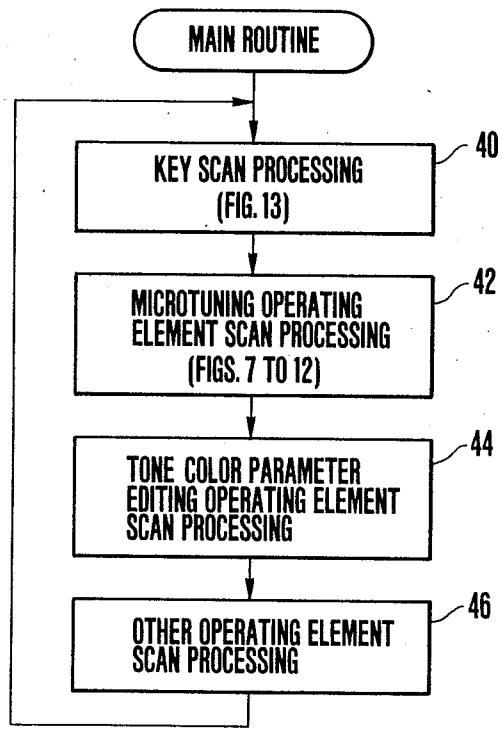
FIG. 6 is a flow chart of a main routine.

Main Routine (FIG. 6)

Figure 13:
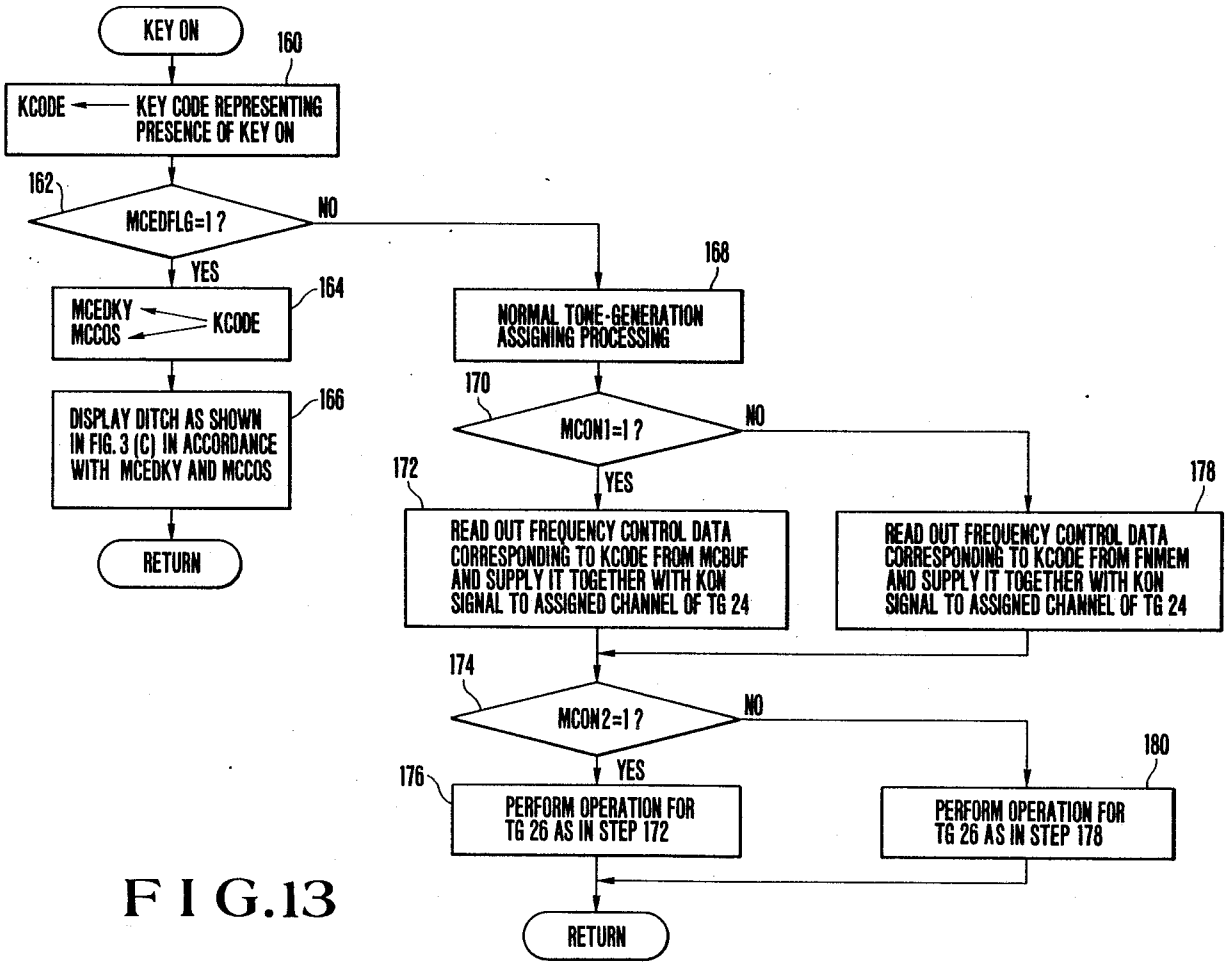
FIG. 13 is a flow chart of a subroutine of "key on".

In a main routine shown in FIG. 6, key scan processing is performed in step 40. If a key-on event is present, a subroutine of "key on" to be described later with reference to FIG. 13 is executed, and if a key-off even is present, a subroutine of "key off" (not shown) is executed.

Figure 8:
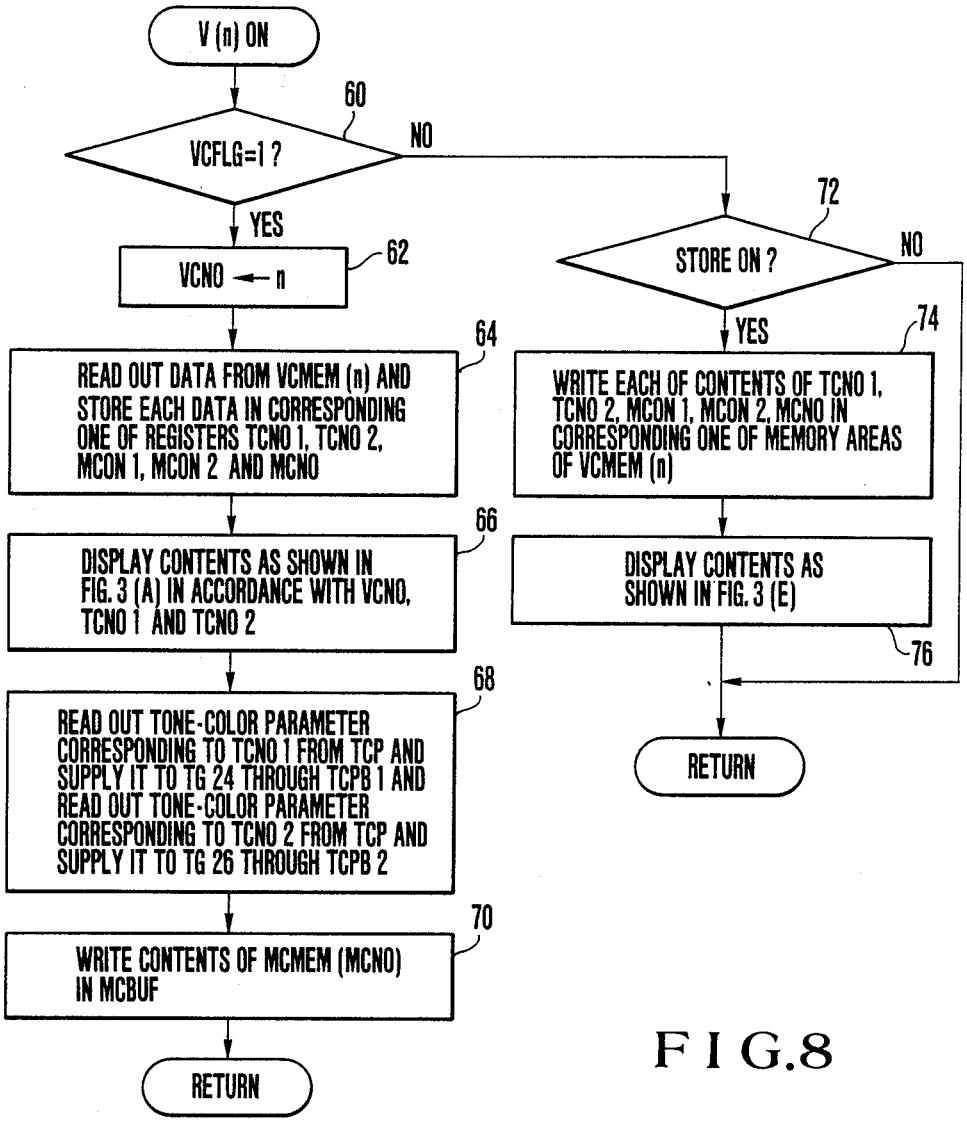
FIG. 8 is a flow chart of a subroutine of "given voice mode selection switch V(n) on"
Figure 12:
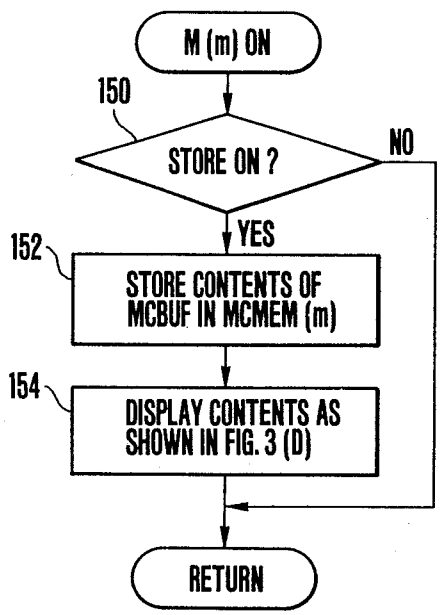
FIG. 12 is a flow chart of a subroutine of "given memory selection switch M(m) on"
Figure 10:
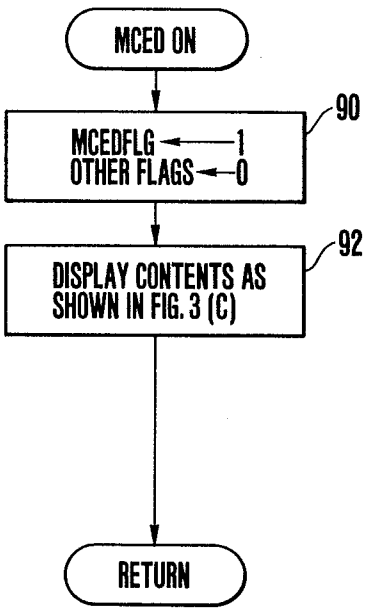
FIG. 10 is a flow chart of a subroutine of "microtuning, edit mode selection switch MCED on"
Figure 9:
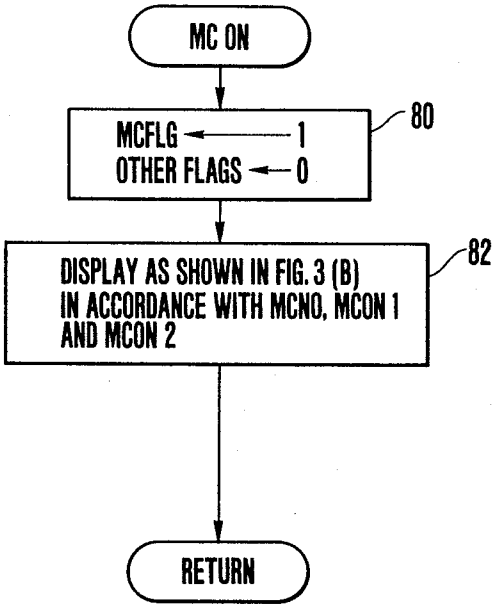
FIG. 9 is a flow chart of a subroutine of "microtuning mode selection switch MC on"
Figure 11A:
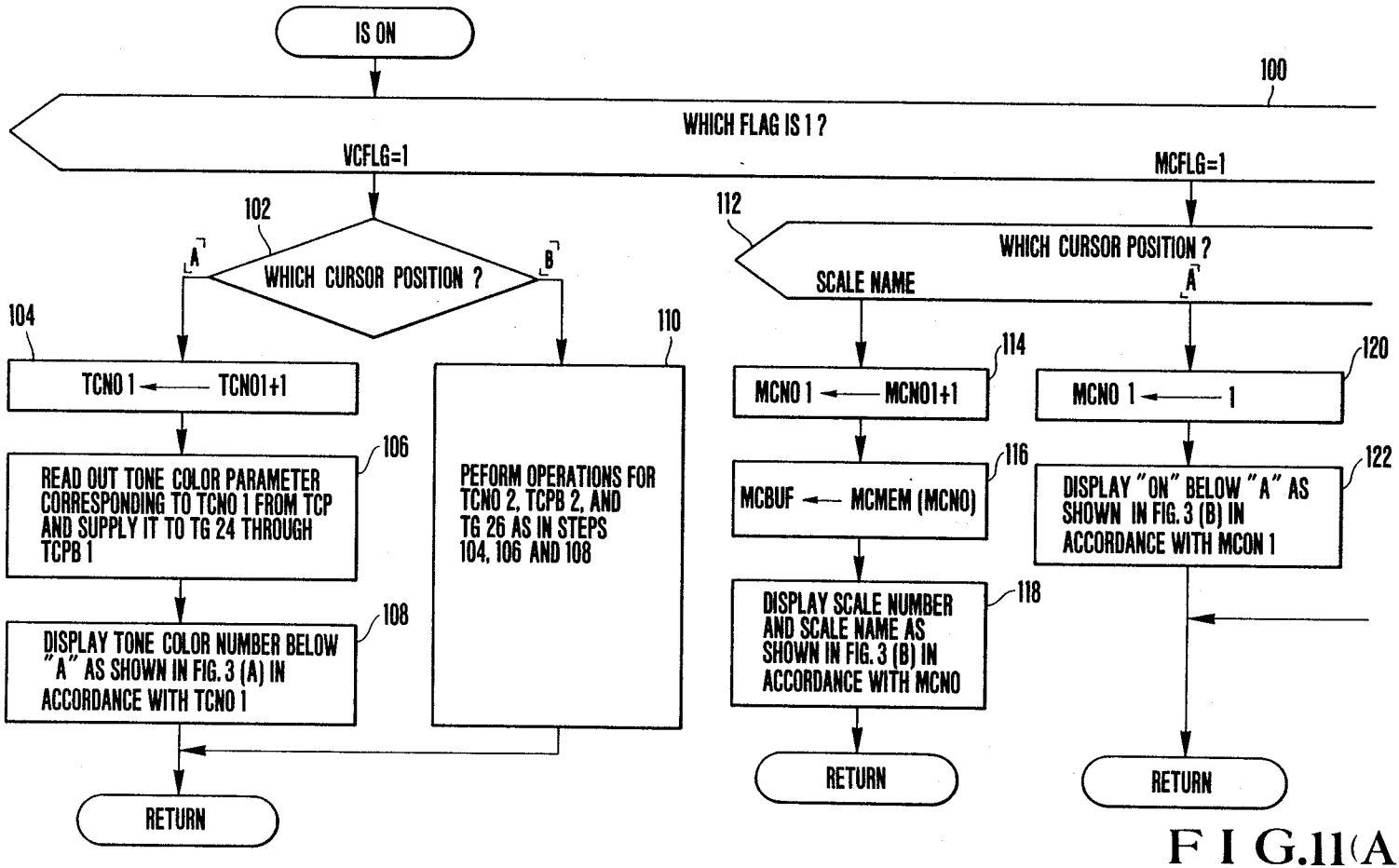
FIGS. 11, 11(A) and 11(B) are flow charts of a subroutine of "increment switch IS on"
Figures 11, 11B:
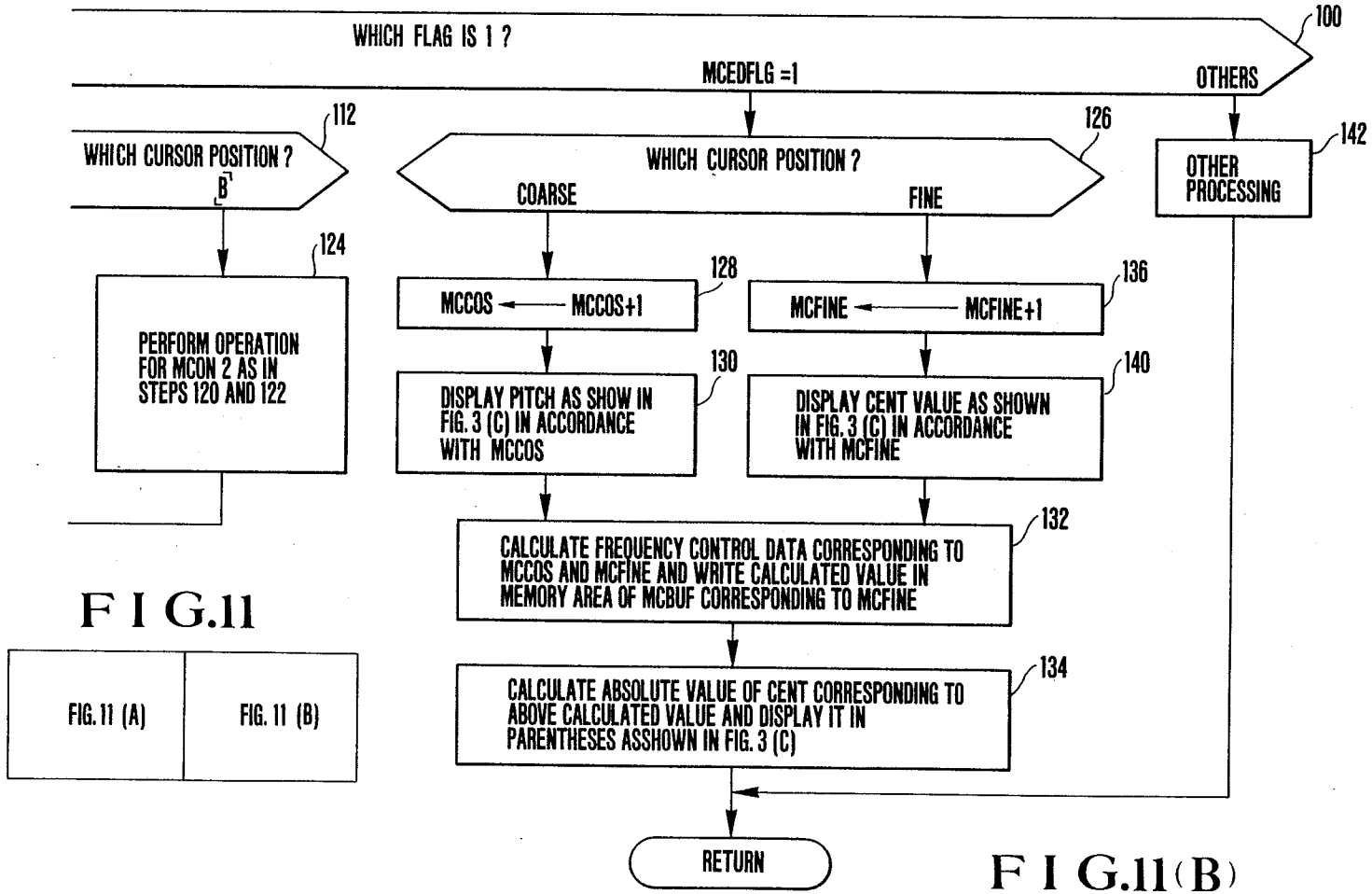

Then, in step 42, microtuning operating scan processing is performed. In this case, if an on-event of the switch VOICE is present, a subroutine of FIG. 7 is executed; if an on-event of a given voice selection switch V(n) is present, a subroutine of FIG. 8 is executed; if an on-event of the switch MC is present, a subroutine of FIG. 9 is executed; if an on-event of the switch MCED is present, a subroutine of FIG. 10 is executed; if an on-event of the switch IS is present, a subroutine of FIG. 11 is executed; if an on-event of the switch DS is present, a subroutine of "DS on" (not shown) is executed; and if an on-event of a given memory selection switch M(m) is present, a subroutine of FIG. 12 is executed.

Then, in step 44, tone-color parameter editing operating scan processing is performed. In this case, tone-color parameter edit processing is performed such that when an operating element associated with the TG 24 or 26 is to be operated, contents of the TCPB1 or TCPB2 are changed in accordance with an operation, and the like.

Thereafter, in step 46, scan processing of other operating elements is performed. If an operated element is detected, necessary processing is performed in accordance with an operation. Then, the flow returns to step 40, and a series of operations as described above are repeated. Subroutine of "VOICE On" (FIG. 7)

Figure 7:
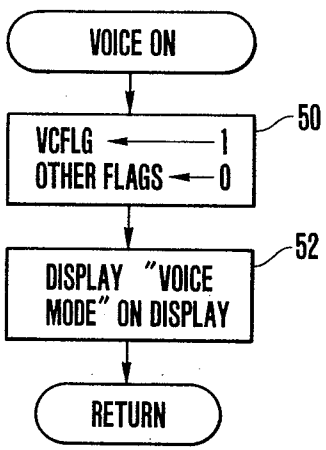
FIG. 7 is a flow chart of a subroutine of "voice mode selection switch VOICE on"

In the subroutine of "VOICE on" in FIG. 7, 1 is set in the VCFLG and 0s are set in the other flags in step 50. Then, the flow advances to step 52.

In step 52, the display DP displays "VOICE MODE". Thereafter, the flow returns to the main routine of FIG. 6.

Subroutine of "V(n) On" (FIG. 8)

In the subroutine of "V(n) on" in FIG. 8, the CPU 16 determines in step 60 whether the VCFLG is 1. If YES (Y) in step 60, the flow advances to step 62, and a voice number n corresponding to the switch tuned on by the VCNO is set. Then, the flow advances to step 64.

In step 64, a group of voice reference data is read out from the VCMEM(n) corresponding to the voice number n. In this case, tone-color number data of the TG 24 is stored in the TCNO1, tone-color number data of the TG 26 is stored in the TCN02, microtuning on/off data of the TG 24 is stored in the MCON1, microtuning on/off data of the TG 26 is stored in the MCON2, and the scale number data is stored in the MCNO. Then, the flow advances to step 66.

In step 66, the display DP displays a voice name and tone-color numbers of the respective tone generators, as shown in FIG. 3(A). Then, the flow advances to step 68.

In step 68, tone-color parameter data corresponding to the tone-color number of the TCNO1 is read out from the TCP and supplied to the TG 24 through the TCPB1. Similarly, tone color parameter data corresponding to the tone-color number of the TCNO2 is read out from the TCP and supplied to the TG 26 through the TCPB2. As a result, tone colors are set for both the TGs 24 and 26. Then, the flow advances to step 70.

In step 70, frequency control data of all the keys are read out from the MCMEM (register or memory block) corresponding to the scale number of the MCNO and written in the MCBUF. Then, the flow returns to the main routine of FIG. 6.

If NO (N) in step 60, the flow advances to step 72, and the CPU 16 determines whether the switch STORE is turned on. If N in step 72, the flow returns to the main routine of FIG. 6.

If Y in step 72, the flow advances to step 74. In step 74, contents of each of the TCNO1, the TCN02, the MCON1, the MCON2, and the MCNO are written in a corresponding one of memory areas of the VCMEM(n). Then, the flow advances to step 76.

In step 76, the display DP displays the contents as shown in FIG. 3(E). Thereafter, the flow returns to the main routine of FIG. 6.

Subroutine of "MC On" (FIG. 9)

In the subroutine of "MC on" in FIG. 9, 1 is set in the MCFLG and 0s are set in the other flags in step 80. Then, the flow advances to step 82.

In step 82, the display DP displays a scale number, a scale name, and microtuning ON/OFFs of the respective tone generators as shown in FIG. 3(B) on the basis of the MCNO, MCON1, and the MCON2. Thereafter, the flow returns to the main routine of FIG. 6.

Subroutine of "MCED On" (FIG. 10)

In the subroutine of "MCED on" in FIG. 10, 1 is set in the MCEDFLG and 0s are set in the other flags in step 90. Then, the flow advances to step 92.

In step 92, the display DP displays the contents as shown in FIG. 3(C). Note that a pitch is not displayed, and numeral 0 is displayed. Thereafter, the flow returns to the main routine of FIG. 6.

Subroutine of "IS On" (FIG. 11)

In the subroutine of "IS on" in FIG. 11, the CPU 16 determines in step 100 which flag is 1.

If the VCFLG is 1, the flow advances to step 102. In step 102, the CPU 16 determines whether the cursor CS is positioned at letter "A" or "B" in the display state shown in FIG. 3(A). If the cursor CS is positioned at "A", the flow advances to step 104.

In step 104, a value of the TCNO1 is incremented by 1. Then, the flow advances to step 106, and tone-color parameter data corresponding to the tone-color number of the TCNO1 is read out from the TCP and supplied to the TG 24 through the TCPB1. As a result, a tone color of the TG 24 is changed to a new one corresponding to the tone-color number set in step 104. Thereafter, the flow advances to step 108.

In step 108, a new tone-color number is displayed below "A" as shown in FIG. 3(A) on the basis of the TCNO1. Then, the flow returns to the main routine of FIG. 6.

If the cursor CS is positioned at "B" in step 102, the flow advances to step 110. In step 110, operations for the TCN02, the TCPB2, and the TG 26 are performed as in steps 104, 106, and 108. As a result, a tone color of the TG 26 is changed to a new one, and a new tone-color number is displayed below "B" as shown in FIG. 3(A).

If the MCFLG is 1 in step 100, the flow advances to step 112. In step 112, the CPU 16 determines whether the cursor CS is positioned at "SCALE NAME", "A", or "B" in the display state as shown in FIG. 3(B). If the cursor CS is positioned at "SCALE NAME", the flow advances to step 114.

In step 114, a value of the MCNO is incremented by 1. Then, the flow advances to step 116, and frequency control data of all the keys are read out from the MCMEM (register or memory block) corresponding to the scale number of the MCNO and stored in the MCBUF. Thereafter, the flow advances to step 118.

In step 118, a new scale number and a scale name are displayed as shown in FIG. 3(B) on the basis of the MCNO. Then, the flow returns to the main routine of FIG. 6.

If the cursor CS is positioned at "A" in step 112, the flow advances to step 120, and 1 is set in the MCON1. Then, the flow advances to step 122.

In step 122, "ON" is displayed below "A" as shown in FIG. 3(B) on the basis of the MCON1. Thereafter, the flow returns to the main routine of FIG. 6.

If the cursor CS is positioned at "B" in step 112, the flow advances to step 124. In step 124, the operation for the MCON2 is performed as in steps 120 and 122. As a result, "ON" is displayed below "B" in FIG. 3(B). Thereafter, the flow returns to the main routine of FIG. 6.

If the MCEDFLG is 1 in step 100, the flow advances to step 126. In step 126, the CPU 16 determines whether the cursor CS is positioned at "COARSE" or "FINE" in the display state as shown in FIG. 3(C). If the cursor CS is positioned at "COARSE", the flow advances to step 128, and a value of the MCCOS is incremented by 1. This incrementation corresponds to a pitch increase of halftone.

Then, in step 130, a new pitch is displayed at a position of "G3" of FIG. 3(C) on the basis of the MCCOS. For example, when "F3" is displayed before the switch IS is turned on and the flow advances to step 130 after that, "F#3" is displayed. Thereafter, the flow advances to step 132.

In step 132, new frequency control data corresponding to the contents of the MCCOS and the MCFINE is calculated, and the calculated value is written in a memory area in the MCBUF corresponding to the MCEDKY. As a result, a new pitch is set for a key corresponding to a key code of the MCEDKY. Thereafter, the flow advances to step 134.

In step 134, an absolute value of cent corresponding to the value calculated in step 132 is obtained and displayed in parentheses as shown in FIG. 3(C). Then, the flow returns to the main routine of FIG. 6.

If the cursor CS is positioned at "FINE" in step 126, the flow advances to step 136, and a value of the MCFINE is incremented by 1. This incrementation corresponds to a pitch increase by 1 cent.

Then, in step 140, a new cent value is displayed together with a symbol (+) as shown in FIG. 3(C) on the basis of the MCFINE.

Thereafter, steps 132 and 134 are sequentially executed as described above, and then the flow returns to the main routine of FIG. 6. As a result, a key pitch corresponding to a key code of the MCEDKY is determined in consideration of an IS-on operation performed when the "FINE" mode is selected, and the absolute value display of cent reflects the IS-on operation.

If other flags are set at 1 in step 100, processing is performed in step 142, and then the flow returns to the main routine of FIG. 6.

Note that although not shown in FIG. 11, after the TCNO1, the TCN02, the MCNO, the MCCOS, the MCFINE, and the like reach respective predetermined maximum values (e.g., 64 for the TCNO1 and the TCN02), they return to respective predetermined minimum values (e.g., 1 for the TCNO1 and the TCN02).

In addition, the subroutine of "switch DS on" is not shown since it can be easily realized by decrementing the values of the TCNO1, the TCN02, the MCNO, the MCCOS, and the MCFINE by 1 and setting 0s in the MCON1 and the MCON2 of the subroutine of FIG. 11.

Subroutine of "M(m) On" (FIG. 12)

In the subroutine of "M(m) on" in FIG. 12, the CPU 16 determines in step 150 whether the switch STORE is turned on. If N in step 150, the flow returns to the main routine of FIG. 6.

If Y in step 150, the flow advances to step 152, and contents (frequency data of all the keys) of the MCBUF are stored in the MCMEM (register) corresponding to the scale number m. Then, the flow advances to step 154.

In step 154, the display DP displays the contents as shown in FIG. 3(D). Then, the flow returns to the main routine of FIG. 6.

Subroutine of "Key On" (FIG. 13)

In the subroutine of "key on" in FIG. 13, a key code corresponding to a key in which key-on is present is In step 162, the CPU 16 determines whether the MCEDFLG is 1. If Y in step 162, the flow advances to step 164.

In step 164, the key code of the KCODE is stored in the MCEDKY and the MCCOS, respectively. Then, the flow advances to step 166.

In step 166, pitches are displayed at positions "F3" and "G3" of FIG. 3(C), respectively, on the basis of the MCEDKY and the MCCOS. In this case, the two displayed pitches correspond to the depressed key and equal to each other. Thereafter, the flow returns to the main routine of FIG. 6.

After the pitch to be changed is displayed as described above, a given pitch can be set by selecting the "COARSE" or "FINE" mode and operating the switch IS or DS as described above with reference to FIG. 11.

If N in step 162, the flow advances to step 168, and normal tone-generation assigning processing is performed. In this processing, empty channels of the TG 24 and 26 are searched, and the depressed key is assigned to a pair of empty channels of the TGs 24 and 26. Thereafter, the flow advances to step 170.

In step 170, the CPU determines whether the MCON1 is 1. If Y in step 170 the flow advances to step 172.

In step 172, frequency control data corresponding to the KCODE is read out from the MCBUF and supplied together with a key-on (KON) signal to the assigned channel of the TG 24. Then, the flow advances to step 174.

In step 174, the CPU 16 determines whether the MCON2 is 1. If Y in step 174, the flow advances to step 176.

In step 176, the operation for the TG 26 is performed as in step 172, and then the flow returns to the main routine of FIG. 6. As a result, musical tone signals having substantially the same pitch are generated substantially at the same time from the TGs 24 and 26, respectively, and supplied to the sound system 28. For this reason, two musical tones are simultaneously generated from the sound system 28. In this case, since the two musical tones generated at the same time are based on the data of the MCBUF and therefore can correspond to a given scale set by the user.

If N (i.e., MCNO1=0) in step 170, the flow advances to step 178.

In step 178, frequency control data corresponding to the KCODE is read out from the FNMEM and supplied together with the KON signal to the assigned channel of the TG 24. Then, the flow advances to step 174, and the CPU 16 determines whether the MCON2=1. If Y in step 174, the processing of step 176 is executed as described above. In this case, of two musical tones generated at the same time, one according to the TG 24 is based on the data of the and the other according to the TG 26 is based on the data of the MCBUF and therefore can correspond to a given scale set by the user.

If N (MCON2=0) in step 174, the flow advances to step 180, and the operation for the TG 26 is performed as in step 178. In this case, if the flow advances to step 180 through step 172, of two musical tones generated at the same time, one according to the TG 24 is based on the data of the MCBUF and therefore can correspond to a given scale set by the user, and the other according to the TG 26 is based on the data of the FNMEM and therefore can correspond to a temperament scale. If the flow advances to step 180 through step 178, each of two musical tones generated at the same time according to the TG 24 or 26 is based on the data of the FNMEM and therefore can correspond to a temperament scale.

Note that a subroutine of "key-off" is not shown. However, this routine may be performed such that assigned channels of a key which is subjected to key off are searched for both the TGs 24 and 26 and then key-off signals are supplied to the assigned channels thereof to stop generation of tones.

Modifications

The present invention is not limited to the above embodiment but can be variously modified. For example, the following modifications may be made.

(1) In the above embodiment, the arbitrarily set pitch curve is commonly used for two systems of sound sources. However, independent pitch curves may be set for these system.

(2) In the above embodiment, the scale number is stored in units of voices. However, frequency control data of all the keys may be directly stored. In addition, in the above embodiment, the tone-color number is stored in units of voices. However, tone-color parameter data may be directly stored.

(3) Although a special scale such as an enharmonic scale requires frequency control data for each key (e.g., C or C#), it is easy to prepare such data and set a pitch curve for each key.

(4) In the above embodiment, the tone-color parameter memory block TCP is constituted by the ROM. However, the TCP may be constituted by a RAM or an external read/write memory so that a user can arbitrarily set the tone-color parameter.

(5) In the microtuning edit mode, designation and display of the pitch change amount need not be performed in units of cents.

(6) In the above embodiment, the increment/decrement switches are used as input operating elements. However, a rotary knob or a ten-key pad may be (7) In the above embodiment, setting of the pitch curve and the like is controlled by a software. However, a special hardware arrangement may be used.

As has been described above, according to the present invention, since a given pitch can be set for each key with respect to at least one of a plurality of sound sources driven in accordance with a key-on operation, a musical tone can be generated therefrom in accordance with a different scale. For this reason, a unique performance effect can be achieved to be similar to an ensemble performance by acoustic musical instruments in which a polyphonic effect can be obtained and varies in accordance with a pitch.

In addition, according to the present invention, a given pitch can be set for each key of a keyboard. Therefore, a user can enjoy expressive performance by arbitrarily correcting an existing scale such as a temperament scale or an enharmonic scale or by creating a desired scale.

Furthermore, since a pitch can be adjusted by either a coarse or fine adjustment mode, a pitch can be precisely and rapidly assigned to each key.

In this case, if a key whose pitch is to be adjusted is designated by depressing the key of a keyboard, a special operating element for designating the key need not be provided. In addition, if one or a set of operating elements are commonly used in both the coarse and fine adjustment modes, the number of necessary operating elements can be reduced, so that a panel arrangement and a circuit configuration can be simplified.

What is claimed is:

1. An electronic musical instrument comprising:
a keyboard having a plurality of keys;
a plurality of tone generating means for generating at least two tone signals in response to operation of a key among said plurality of keys;
a pitch designating means for designating a pitch of a musical tone to be produced;
a plural pitch data generating means for generating at least two pitch data with different scale characteristics based on said designated pitch; and
a musical tone generating means for generating at least two musical tone signals having tone colors and pitches based on said at least two pitch data responsive to an operation of said key, so that said at least two musical tone signals have said different scale characteristics.

2. An electronic musical instrument according to claim 1, wherein said at least two musical tone signals have different tone colors and the same pitches.

3. An electronic musical instrument comprising:
a keyboard having a plurality of keys;
a musical tone generating means for generating a plurality of musical tones in response to operation of a key among said plurality of keys;
a plurality of memories corresponding to said plurality of keys;
an input device for storing pitch control data in said plurality of memories, said pitch control data representing a pitch to be generated corresponding to each of said plurality of keys;
mode designating means for designating an input mode;
writing means for writing, when the input mode is designated, the pitch control data according to operation of said input device in one of said plurality of memories corresponding to a depressed key; and
pitch control means for controlling, when the input mode is not designated, a pitch of one of musical tones generated in response to the depressed key on the basis of the pitch control data in one of said plurality of memories corresponding to the depressed key.

4. An electronic musical instrument according to claim 3, wherein said input device comprises coarse adjustment input operating means and fine adjustment input operating means.

5. An electronic musical instrument with key tone generating function, comprising:
a plurality of memory means corresponding to a plurality of keys of a keyboard, each of said memory means storing pitch control data concerning a corresponding one of said keys so that a scale corresponding to each of said memory means is formed, said formed scales being of different types from each other;
input operating means for selectively performing one of a coarse adjustment operation and a fine adjustment operation; and
rewriting means for rewriting pitch control data of one of said plurality of memory means which corresponds to a desired key in response to operation of said input operating means, said rewriting means rewriting the pitch control data in correspondence with the coarse adjustment operation for a relatively large pitch change amount and rewriting the pitch control data in correspondence with the fine adjustment for a relatively small pitch change amount,
wherein a pitch of a musical tone generated in accordance with a depressed key of said keyboard is controlled on the basis of pitch control data of one of said plurality of memory means corresponding to the depressed key.

6. An electronic musical instrument according to claim 5, wherein said rewriting means rewrites the pitch control data of one of said plurality of memory means corresponding to a depressed key of said keyboard.

7. An electronic musical instrument according to claim 5, wherein said input operating means comprises one or a plurality of operating elements commonly used for the coarse and fine adjustment operations and selecting means for selecting whether said operating elements are used for the coarse or fine adjustment operation.

* * * * *

UNITED STATES PATENT AND TRADEMARK OFFICE

CERTIFICATE OF CORRECTION

PATENT NO. : 4,947,724

DATED : 8/14/90

INVENTOR(S) : Hirano et al.

It is certified that error in the above-identified patent and that said Letters Patent is hereby corrected as shown below:

| | | |
|---|---|---|
| col. 05, line 48 | delete " "Bl" " | insert --"B"-- |
| col. 06, line 23 | delete "=" | insert --+-- |
| col. 06, line 68 | delete "TCN02" | insert --TCNO2-- |
| col. 07, line 03 | delete "TG" | insert --TG 26-- |
| col. 07, line 11 | delete "turned on" | |
| col. 07, line 12 | after "is" (2nd occurrence) | insert --turned on-- |
| col. 07, line 62 | delete "FNMEN" | insert --FNMEM-- |
| col. 11, line 25 | delete "TCN02" | insert --TCNO2-- |
| col. 11, line 28 | delete "TCN02" | insert --TCNO2-- |
| col. 11, line 29 | delete "TCN02" | insert --TCNO2-- |
| col. 11, line 32 | delete "TCN02" | insert --TCNO2-- |

UNITED STATES PATENT AND TRADEMARK OFFICE

CERTIFICATE OF CORRECTION

PATENT NO. : 4,947,724

DATED : August 14, 1990

INVENTOR(S) : Hirano, et al.

It is certified that error appears in the above-identified patent and that said Letters Patent is hereby corrected as shown below:

| | | |
|---|---|---|
| col. 11, line 52 | after "is"(2nd occurrence) | insert --set in step 160. Then, the flow advances to step 162.-- |
| col. 12, line 39 | after "the"(3rd occurrence) | insert --FNMEM and therefore can correspond to a temperament scale,-- |

Signed and Sealed this

Ninth Day of February, 1993

*Attest:*

STEPHEN G. KUNIN

*Attesting Officer*

*Acting Commissioner of Patents and Trademarks*